United States Patent [19]

Makimura et al.

[11] Patent Number: 4,663,221

[45] Date of Patent: May 5, 1987

[54] FABRIC COMPRISING COMPOSITE SHEATH-CORE FIBERS, FABRIC COMPRISING BICOMPONENT FIBER BUNDLES AND PROCESS FOR ITS PREPARATION

[75] Inventors: Masaru Makimura; Setsuo Yamashita, both of Kurashiki, Japan

[73] Assignee: Kuraray Co., Ltd., Kurashiki, Japan

[21] Appl. No.: 829,437

[22] Filed: Feb. 13, 1986

[30] Foreign Application Priority Data

Feb. 18, 1985 [JP] Japan ..... 60-31121

[51] Int. Cl.[4] ..... D02G 3/00; D03D 3/00

[52] U.S. Cl. ..... 428/224; 264/171; 264/177.1; 428/373; 428/397

[58] Field of Search ..... 428/373, 374, 397, 224, 428/903; 264/171, 177 F, 176 F, 147

[56] References Cited

U.S. PATENT DOCUMENTS

| | | | |
|---|---|---|---|
| 3,111,805 | 11/1963 | Boyer . | |
| 3,966,866 | 6/1976 | Ballman et al. | 264/171 |
| 3,987,141 | 10/1976 | Martin | 264/171 |
| 4,381,335 | 4/1983 | Okamoto | 428/224 |
| 4,447,489 | 5/1984 | Linhart et al. | 264/171 |
| 4,557,972 | 12/1985 | Okamoto et al. | 428/397 |

FOREIGN PATENT DOCUMENTS

| | | | |
|---|---|---|---|
| 37-5278 | 1/1962 | Japan . | |
| 45-18062 | 6/1970 | Japan | 264/171 |
| 46-28976 | 8/1971 | Japan | 264/171 |
| 47-35614 | 9/1972 | Japan | 264/171 |
| 59-11690 | 3/1984 | Japan . | |

*Primary Examiner*—Lorraine T. Kendell

*Attorney, Agent, or Firm*—Kramer and Brufsky

[57] ABSTRACT

There is provided a fabric made of sheath-core type composite fibers in which the core is made of an elastomer (A) and occurs in a fineness of not less than 0.15 denier per core piece and the sheath is either made of sea-island phase whose island component is a nonelastic, fiber-forming polymer (B) and occurs in each fiber in the form of a large number of fine island pieces having a fineness of less than 0.15 denier and whose sea component is a soluble polymer (C), or made of a multilayer laminate phase with the nonelastic, fiber-forming polymer (B) and the soluble polymer (C) occurring radially and alternately. Also provided is a fabric derived from the above fabric by removal of the soluble polymer (C) in the composite fibers by treatment with a solvent. The resultant fabric comprises bicomponent fiber bundles each composed of a core fiber of elastomer (A) and a large number of ultrafine fibers of nonelastic polymer (B) surrounding the core fiber.

4 Claims, 4 Drawing Figures

FABRIC COMPRISING COMPOSITE SHEATH-CORE FIBERS, FABRIC COMPRISING BICOMPONENT FIBER BUNDLES AND PROCESS FOR ITS PREPARATION

FIELD OF THE INVENTION

This invention relates to (1) fabric produced from sheath-core composite fibers without encountering any special troubles in the production process, and capable of affording, upon removal of a soluble polymer component of the sheath and shrinking or stretching treatment, and (2) to a further fabric showing high elongation and high elastic recovery and having soft feel and touch and elegant appearance, and a process for producing such fabric.

DESCRIPTION OF THE PRIOR ART

Bicomponent fiber bundles each consisting of a nonelastic fiber and an elastic fiber are known. For example, Japanese patent publication No. 11,690/84 discloses a process for producing such fiber bundles by taking up a polyurethanebased filament yarn and a nonelastic staple fiber fleece with twisting. Japanese Patent Publication No. 5,278/62 discloses a process for producing bicomponent fiber bundles each composed of an elastic fiber and a nonelastic fiber by spinning an elastomer and a nonelastic polymer having weak adhesivity to said elastomer in an eccentric sheath-core form and separating both components from each other at the interface therebetween in production step such drawing shrinking step However, it is very difficult to produce a fabric, for example a woven or knit or nonwoven fabric, showing high elongation and constant and uniform elastic recovery by using the bicomponent fiber bundles obtained in any of such known processes, since the elongation and elastic recovery characteristics differ markedly between the elastic fiber and nonelastic fiber in each fiber bundle. Furthermore, the known processes use relatively thick nonelastic fibers and, in such case, the resulting fabrics can have neither soft feel and touch nor velvet-like elegant appearance even after napping. When ultrafine nonelastic fibers are used as the nonelastic fibers in the above-mentioned prior art processes, said ultrafine fibers readily break in the step of fabric production from the resulting bicomponent fiber bundles; the elastic fibers and nonelastic fibers become separated from each other and cause problems in the weaving or knitting step as a result of their winding around or getting twisted round the machine elements. Thus, the known processes cannot produce fabrics showing high elongation and excellent elastic recovery and having the desired soft feel and touch and velvet-like elegant appearance without encountering one or more problems in the process of their production. Furthermore, the bicomponent fiber bundles obtained in the prior art processes are all intended for use as filaments. If these bicomponent fiber bundles are blended, in the staple fiber form, with other fibers for blended yarn production or processes into a nonwoven fabric, the high elongation and high elastic recovery characteristics of the elastic fibers as mentioned above make it difficult to conduct such steps as crimping and carding and, moreover, make the product yarns or nonwoven fabric nonuniform in quality.

It is a principal object of the invention to provide a fabric showing much higher elongation than can be attained in the prior art processes, the fabric also having excellent elastic recovery and furthermore being capable of readily producing a fabric having soft feel and touch and velvet-like elegant appearance upon surface napping, without encountering problems due to fiber breakage and so forth in the process of its production. Another object of the invention is to provide fibers which, even in the staple form, do no cause problems in mix spinning with other fibers or in producing nonwoven fabrics therefrom.

SUMMARY OF THE INVENTION

This invention provides a fabric made of sheath-core type composite fibers in which the core is made of an elastomer (A) and the sheath is either made of a sea-island phase whose island component is a nonelastic fiber-forming polymer (B) and whose sea component is a soluble polymer (C) or is made of a multilayer laminate phase surrounding the core with said polymer (B) and said polymer (C) occuring radially and alternately, said elastomer (A) occurring in a fineness of not less than 0.15 denier per piece in said fibers and said polymer (B) occurring in a fineness of less than 0.15 denier per piece.

The invention further provides a fabric made of bicomponent fiber bundles each of which is composed of at least one fine core fiber of an elastomer (A) having a fineness of not less than 0.15 denier per piece and of not more than 10 denier per piece and a plurality of ultrafine fibers of a nonelastic polymer (B) each having a fineness of less than 0.15 denier, said plurality of ultrafine fibers surrounding said fine core fiber, said fabric being derived from the above-mentioned sheath-core type composite fiber-made fabric upon removal of the soluble polymer (C).

BRIEF DESCRIPTION OF THE DRAWINGS

In the accompanying drawings, each of FIG. 1, FIG. 2 FIG. 3 shows a composite fiber composed of a core and a sheath which is a multilayer laminate phase with the layers disposed radially.

DETAILED DESCRIPTION OF PREFERRED EMBODIMENTS

In accordance with the invention, the component (A) which is to form an elastic fiber or fibers and the component (B) which is to form nonelastic fibers remain in a mutually bonded state until the composite fiber-made fabric is produced by weaving or knitting. As a result, the expression of the elongation and elastic recovery characteristics of the elastomer (A) is restricted and accordingly the elongation and elastic recovery of the sheath-core type composite fibers constituting the fabric according to the invention remain as low as in the case of ordinary nonelastic fibers. Therefore, there never arise the problems which are often encountered in the prior art processes during the steps of weaving or knitting, mix spinning, and carding, etc., as a result of marked differences in elongation and elastic recovery characteristics between the elastomer and nonelastic polymer. Furthermore, in spite of the fact that the nonelastic fibers in the final product are ultrafine fibers having a fineness of less than 0.15 denier, said fibers are retained in the state in which they are bonded to the soluble polymer component (C) and/or elastomer component (A) until they are made up into a fabric, so that problems caused by ultrafine fibers in fabric production are never encountered. Moreover, removal of the component (C) from the fabric according to the invention by extraction, followed by shrinking or stretching treatment of the fabric yields a fabric showing high elongation and excellent elastic recovery. The subsequent surface napping, if performed, further gives soft feel and touch and velvet-like elegant napped appearance to the fabric.

Figure 1:
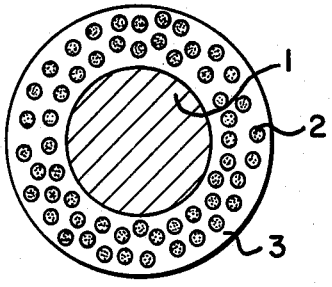
In FIG. 1, the composite fiber is composed of one core and a sheath consisting of a sea-island phase. The composite fiber shown in FIG. 2 is composed of a plurality of cores and a sheath consisting of a sea-island phase.
Figure 2:
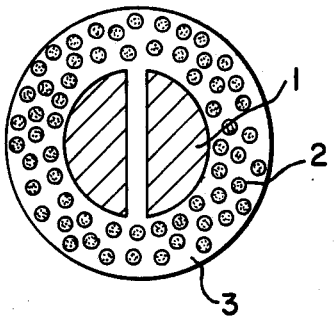
Figure 3:
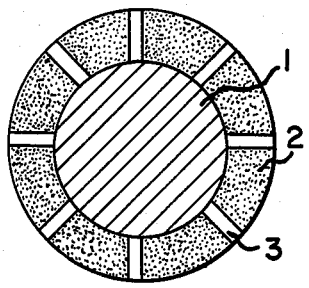
FIG. 3 shows the structure of a sheath-core type composite fiber for constructing a fabric according to the invention.

The sheath-core type composite fibers for constituting the fabric according to the invention can be prepared by any of the conventional composite fiber spinning techniques using the elastomer (A) as the core component and the nonelastic polymers (B) and (C) as the sheath components. The number of cores in each composite fiber is not limited to one but multicore type composite fibers may also be used. As already mentioned hereinabove, the sheath component phase in accordance with the invention may consist either (1) of a sea-island phase whose island component is a nonelastic, fiber-forming polymer (B) and whose sea component is a soluble polymer (C) or (2) of a multilayer laminate phase with such polymer (B) and such polymer (C) occurring radially and alternately. Some typical examples of such composite fibers are shown in the drawing. FIG. 1 and FIG. 2 show examples of the above case (1) and FIG. 3 shows an example of the above case (2). In the figures, 1 is the core component consisting of an elastomer (A). The fibers shown in FIG. 1 and FIG. 3 have one core, whereas FIG. 2 shows a fiber having a plurality of cores. In the figures, 2 indicates a nonelastic, fiber-forming polymer (B) and 3 a soluble polymer (C). A sea-island structure in which said polymer (B) serves as the island component and said polymer (C) as the sea component can be produced in the same manner as in so-called mixed spinning or multicomponent polymer spinning, for example by conducting spinning while blending polymer (B) and polymer (C) in the chip or pellet form or statically or dynamically blending the polymers after melting separately in different melting systems or forming a polymer (B)-polymer (C) mixed system on the spinneret site. Multilayer laminate sheath structures such as shown in FIG. 3 can be produced also in the manner of the above-mentioned multicomponent fiber spinning.

A typical and most preferred example of the elastomer (A) to be used as the core component is a thermoplastic polyurethane.

Said thermoplastic polyurethane for use in the practice of the invention can be prepared by chain extension using, as a soft segment component, a high molecular diol having an average molecular weight within the range of 600–3,500, such as a polyester glycol obtainable by polycondensation of a glycol and an aliphatic dicaboxylic acid, a polylactone glycol obtainable by ring opening polymerization of a lactone, an aliphatic or aromatic polycarbonate glycol or a polyether glycol, or a mixture of two or more of these, and, as chain extenders, an organic diisocyanate, such as tolylene diisocyanate, 4,4'-diphenylmethane diisocyanate, isophorone diisocyanate or 4,4'-dicyclohexylmethane diisocyanate, and a low molecular-weight compound having at least two active hydrogen atoms.

Examples of the nonelastic, fiber-forming polymer (B) are spinnable polyesters, such as polyethylene terephthalate polymers, polybutylene terephthalate, polybutylene terephthalate-based copolymers, aliphatic polyesters and aliphatic polyester-based copolymers, spinnable polyamides, such as nylon-6, nylon-6,6, nylon-6-nylon-6,6 copolymer, nylon6,10and nylon-12, polyolefins, such as polyethylene and polypropylene, acrylonitrile-based copolymers, and saponified ethylene-vinyl acetate copolymers.

As the soluble polymer (C), there may be mentioned those polymers which are soluble in a solvent incapable of dissolving either of said polymers (A) and (B), for example polyolefins, such as polyethylene, polypropylene and polybutylene, olefin copolymers, polystyrene, styrene copolymers, polyvinyl chloride, vinyl chloride copolymers, polyesters and polycarbonates. It is of course necessary that the combination of polymers (A), (B) and (C) should be such that the polymers (A) and (B) are substantially insoluble in the solvent to be used later in removing the polymer (C) by extraction therewith. Typical examples of the combination of polymer (B) and polymer (C) are polyethylene terephthalate/polyethylene, nylon-6/polyethylene, polybutylene terephthalate/polystyrene and polypropylene/polystyrene. Furthermore, the polymer (B) need not be a single polymer but may be a combination of two or more polymers. Thus, for instance, a system in which the polymer (B) is a combination of polybutylene terephthalate and nylon-6 and the polymer (C) is polyethylene may be used.

The term "elastomer" as used herein means a polymer such that a fiber formed therefrom shows a stretch elastic recovery of not less than 90% one minute after 50% elongation at room temperature. The term "nonelastic polymer" means a polymer such that a fiber made therefrom shows a stretch elastic recovery of not more than 50% when tested in the same manner as above or a polymer such that a fiber made therefrom shows an elongation at break of less than 50% at room temperature.

In the sheath-core type composite fibers constituting the fabric according to the invention, the polymer component (B) is preferably divided in each composite fiber into at least 5 pieces per piece of the core component. In other words, it is preferable that, in the fiber bundles obtained after removal by extraction of the soluble polymer (C) from said sheath-core type composite fibers, the number of nonelastic ultrafine fibers is at least 5 times greater than the number of elastic fibers. If the number is less than 5-fold, the fabric obtained after napping is inferior in softness of feel and touch and in velvet-like elegant nap appearance.

The proportion of the core component polymer (A) in the sheath-core type composite fibers is preferably 20–80% by weight, more preferably 30–70% by weight. A great deviation of the weight proportion of polymer (A) from said range will result in loss of elongation and elastic recovery characteristics and loss of softness of feel and touch, amoung other things. The weight proportion of the polymer (C) relative to the polymers (A) and (B) is not critical since the polymer (C) component is later removed by extraction. From the economic viewpoint, however, the amount of polymer (C) is preferable not more than twice the total amount of polymer (A) and polymer (B). As for the lower limit of polymer (C), this depends on the requirement that sheath-core type composite fibers such as mentioned above should be obtained.

The sheath-core type composite fibers thus obtained are drawn in wet hot or dry hot condition as in the case of ordinary nonelastic fibers and, after crimping as necessary, cut and, as necessary, spun into yarns. The fibers or yarns thus produced are made up into a fabric by weaving or knitting or made up into a nonwoven fabric.

When the polymer (C) is removed by extraction from the fabric obtained, elastic fibers and ultrafine fibers are formed. For said removal by extraction, a solvent such as toluene or perchloroethylene is generally used. In the composite fibers before such removal by extraction, the elastic fiber component (A) occurs in a fineness of not less than 0.15 denier per piece. After separation, the pieces of elastic fiber component become fine fibers having a fineness within the range of 0.15–10 denier. The ultrafine nonelastic fiber component (B) must occur in said fibers in a fineness of less than 0.15 denier per piece. When the elastic fiber component (A) has a fineness of less than 0.15 denier, the elastic fibers formed after extraction cannot produce favorable characteristic properties. On the other hand, when the ultrafine nonelastic fiber component (B) occurs in a fineness of not less than 0.15 denier, softness on touching and elegant nap appearance cannot be obtained and, furthermore, the elastic recovery of the elastic fibers is inhibited. It is preferable that said component (B) occur in a fineness of not more than 0.1 denier.

Figure 4:
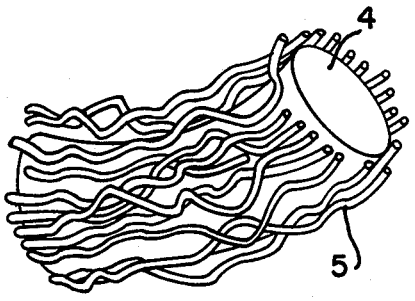
FIG. 4 illustrates the structure of a bicomponent fiber bundle obtained after removal from the sheath of the soluble polymer which is a constituent of the sheath-core type composite fiber mentioned above.

When the polymer component (C) is removed by extraction from the composite fiber-containing fabric according to the invention and the fabric is caused to shrink, the elastic fibers in the fabric come into a taut condition while the ultrafine nonelastic fibers come into a slack condition (namely such a condition as shown in FIG. 4). Thereby a fabric excellent in elongation and elastic recovery characteristics is produced. When the elastic fibers already undergo shrinking upon removal by extraction of the polymer component (C) from the composite fiber-containing fabric, no particular shrinking treatment is required. When the elastic fibers reach a taut state and the ultrafine fibers a slack state upon stretching of the fabric after extraction followed by removal of the stretching force, no particular shrinking treatment is required either. In FIG. 4, 4 is an elastic fine fiber and 5 is a nonelastic ultrafine fiber.

The following examples illustrate the invention in further detail.

EXAMPLES 1–5

Using an ester-based polyurethane as the core component and a chip blend composed of a copolymer of nylon-6 and nylon-6,6 and a low-density polyethylene (the nylon-6-nylon-6,6 copolymer to serve as the island component and the low-density polyethylene as the sea component) as the sheath component, sheath-core type composite fibers as shown in the crosssectional view of FIG. 1 were produced by extruding the above components in varied weight proportions, as set out in Table 1, through a 48-hole spinneret for spinning such fibers (nozzle diameter 0.3 mm and L/D=2) at a spinning temperature of 230° C. and at a take-up speed of 1,000 meters per minute. The fiber thickness was 10 denier. The fibers obtained were wet-hot drawn to a 2.5-fold length at 80° C., followed by crimping and cutting. A random web was produced using the resulting fabrics, and the fibers were entangled by needle punching to give a nonwoven fabric. Problems which would be usual in the case of ordinary nonelastic fibers were not encountered either in the fiber production process or in the nonwoven fabric production process. The low-density polyethylene component was removed from the thus-obtained nonwoven fabric by extraction with perchloroethylene at 95° C. In the resulting fabric, the sheath-core composite fibers each were converted to a bicomponent fiber bundle composed of a polyurethane fiber having a fineness as shown in Table 1 and ultrafine nylon fibers surrounding said polyurethane fiber having an average fineness as shown in Table 1, the number of said ultrafine nylon fibers being as shown in Table 1. The polyurethane fibers were in a taut condition in the nonwoven fabric whereas the ultrafine nylon fibers were in a slack condition.

TABLE 1

| | Proportion in sheath-core fiber | | Fibers after extraction | | |
|---|---|---|---|---|---|
| | Core component | Sheath component (sea/island) | Polyurethane fiber | Nylon fiber | Number of nylon fibers |
| Example 1 | 60 | 40 (20/20) | 6.7 denier | 0.005 denier | 160 |
| Example 2 | 40 | 60 (30/30) | 4.4 denier | 0.005 denier | 240 |
| Example 3 | 20 | 80 (40/40) | 2.2 denier | 0.005 denier | 320 |
| Example 4 | 90 | 10 (5/5) | 10 denier | 0.005 denier | 40 |
| Example 5 | 10 | 90 (45/45) | 1.1 denier | 0.005 denier | 360 |

The surface of each stretchable nonwoven fabric thus obtained was buffed with a sandpaper and the thus-obtained stretchable nonwoven fabric having a napped surface (suede-like surface) was tested for stretchability (elastic recovery) and bulkiness (softness of feel and touch). The results are shown in Table 2.

TABLE 2

| | Stretchability | Bulkiness |
|---|---|---|
| Example 1 | Very good | Very good |
| Example 2 | Very good | Very good |
| Example 3 | Very good | Very good |
| Example 4 | Very good | Lacking in bulkiness and slightly inferior in softness of touch |
| Example 5 | Somewhat poor in elastic recovery | Very good |

EXAMPLES 6–9 AND COMPARATIVE EXAMPLE 1

Composite fiber spinning was conducted following the procedure of the above examples but using polyethylene terephthalate (hereinafter referred to as "polyester" for short) and polystyrene as the sheath components and in a manner such that the sheath phase of the sheath-core type composite fibers occurs as a multilayer laminate structure as shown in FIG. 3. Thus, in FIG. 3, the polymer corresponding to 1 is the polyurethane, the polymer corresponding to 2 is the polyester and the polymer corresponding to 3 is the polystyrene. The proportions of the respective components in the sheath-core type composite fibers, the fineness of fine polyurethane fiber formed after removal of the polystyrene by extraction with perchloroethylene at 95° C. and the fineness and the number per core of ultrafine polyester fibers were as shown in Table 3.

TABLE 3

| | Proportion in sheath-core fiber | | Fibers after extraction | | |
|---|---|---|---|---|---|
| | Core component | Sheath component (PES*/PST*) | Polyurethane fiber | Polyester fiber | Number of polyester fibers |
| Example 6 | 60 | 40 (20/20) | 6.7 denier | 0.1 denier | 8 |
| Example 7 | 40 | 60 (30/30) | 4.4 denier | 0.075 denier | 16 |
| Example 8 | 20 | 80 (40/40) | 2.2 denier | 0.1 denier | 16 |
| Example 9 | 90 | 10 (5/5) | 10 denier | 0.025 denier | 8 |
| Comparative Example 1 | 10 | 90 (45/45) | 1.1 denier | 0.225 denier | 8 |

*PES: Polyester; PST: Polystyrene

No troubles were encountered in any of these examples, including the comparative example, either in the fiber production process or in the nonwoven fabric production process. The results of evaluation of the napped nonwoven fabrics with respect to stretchability and bulkiness are shown in Table 4.

TABLE 4

| | Stretchability | Bulkiness |
|---|---|---|
| Example 6 | Very good | Very good |
| Example 7 | Very good | Very good |
| Example 8 | Very good | Very good |
| Example 9 | Very good | Somewhat poor |
| Comparative Example 1 | Poor | Somewhat poor in softness of feel and touch |

We claim:

1. A fabric comprising sheath-core type composite fibers in which the core is made of an elastomer (A) and the sheath either comprises a sea-island phase whose island component is a nonelastic fiber-forming polymer (B), and whose sea component is a soluble polymer (C) or comprises a multilayer laminate phase surrounding the core with said polymer (B) and said polymer (C) occurring radially and alternately, said elastomer (A) occurring in a fineness of not less than 0.15 denier per piece in said fibers and said polymer (B) occurring in a fineness of less than 0.15 denier per piece.

2. A fabric according to claim 1 wherein, in the composite fibers, the elastomer (A) is a polyurethane.

3. A fabric according to claim 1 wherein, in the composite fibers the fiber-forming polymer (B) is selected from the group consisting of polyesters, polyamides, polyolefins and mixtures thereof.

4. A fabric according to claim 1 wherein, in the composite fibers, the soluble polymer (C) is selected from the group consisting of polystyrene, polystyrene copolymers, polyethylene and polyethylene copolymers.

* * * * *